US011197504B2

(12) United States Patent
Lee

(10) Patent No.: US 11,197,504 B2
(45) Date of Patent: Dec. 14, 2021

(54) AEROSOL GENERATOR PROVIDING EASY AND QUICK CLEANING

(71) Applicant: KT&G CORPORATION, Daejeon (KR)

(72) Inventor: Jong Sub Lee, Seongnam-si (KR)

(73) Assignee: KT&G CORPORATION, Daejeon (KR)

( * ) Notice: Subject to any disclaimer, the term of this patent is extended or adjusted under 35 U.S.C. 154(b) by 64 days.

(21) Appl. No.: 16/650,196

(22) PCT Filed: Mar. 7, 2019

(86) PCT No.: PCT/KR2019/002638
§ 371 (c)(1),
(2) Date: Mar. 24, 2020

(87) PCT Pub. No.: WO2019/235720
PCT Pub. Date: Dec. 12, 2019

(65) Prior Publication Data

US 2020/0214351 A1 Jul. 9, 2020

(30) Foreign Application Priority Data

Jun. 4, 2018 (KR) ..... 10-2018-0064486

(51) Int. Cl.
*A24F 40/48* (2020.01)

(52) U.S. Cl.
CPC ..... *A24F 40/48* (2020.01)

(58) Field of Classification Search
CPC ..... A24F 40/48; A24F 40/20; A24F 40/85; A24F 40/40
USPC ..... 131/328, 329
See application file for complete search history.

(56) References Cited

U.S. PATENT DOCUMENTS

| | | | | |
|---|---|---|---|---|
| 10,314,341 | B2 * | 6/2019 | Shin | A24F 40/40 |
| 2014/0299125 | A1 | 10/2014 | Buchberger | |
| 2017/0172215 | A1 | 6/2017 | Li et al. | |
| 2020/0187555 | A1 * | 6/2020 | Lee | A24F 40/40 |
| 2020/0214355 | A1 * | 7/2020 | Lee | A24F 40/46 |

(Continued)

FOREIGN PATENT DOCUMENTS

| | | | |
|---|---|---|---|
| JP | 2014-216287 | A | 11/2014 |
| JP | 2015-13192 | A | 1/2015 |

(Continued)

OTHER PUBLICATIONS

Korean Office Action for 10-2018-0064486 dated Jul. 10, 2019.
International Search Report for PCT/KR2019/002638 dated Jun. 12, 2019 (PCT/ISA/210).

*Primary Examiner* — Hae Moon Hyeon
(74) *Attorney, Agent, or Firm* — Sughrue Mion, PLLC

(57) ABSTRACT

An aerosol generating apparatus includes a case including an insertion pipe for surrounding and supporting at least a portion of a cigarette and an extraction member that includes a disk for supporting a lower end of the cigarette, the extraction member being slidably installed on the case. The insertion pipe includes a step portion that is concaving away from an external surface to form an internal surface of the insertion pipe to allow mounting of the extraction member on the step portion, and based on the extraction member being removed from the case, the disk is configured to pressurize the lower end of the cigarette so that the cigarette is removed from the case.

12 Claims, 8 Drawing Sheets

(56) References Cited

U.S. PATENT DOCUMENTS

| | | | | |
|---|---|---|---|---|
| 2020/0245681 | A1* | 8/2020 | An | A24F 40/46 |
| 2020/0352230 | A1* | 11/2020 | An | A24F 40/40 |
| 2020/0352235 | A1* | 11/2020 | Lee | A24F 40/60 |
| 2021/0059300 | A1* | 3/2021 | An | A24F 40/40 |

FOREIGN PATENT DOCUMENTS

| | | | |
|---|---|---|---|
| JP | 2017-163974 | A | 9/2017 |
| KR | 10-1631286 | B1 | 6/2016 |
| KR | 10-1667124 | B1 | 10/2016 |
| KR | 10-2018-0023621 | A | 3/2018 |
| WO | 2013/076098 | A2 | 5/2013 |
| WO | 2015/174657 | A1 | 11/2015 |
| WO | 2017/194764 | A1 | 11/2017 |

* cited by examiner

AEROSOL GENERATOR PROVIDING EASY AND QUICK CLEANING

TECHNICAL FIELD

Embodiments relate to an apparatus for generating aerosols, and more particularly, to an aerosol generating apparatus which is easy to clean.

BACKGROUND ART

Recently, there has been an increasing demand for an aerosol generating apparatus for generating aerosols from components in a cigarette by heating the cigarette. In an aerosol generating apparatus including a heater for heating a cigarette, after using the cigarette, the cigarette may be removed from the aerosol generating apparatus and a new cigarette may be inserted into the aerosol generating apparatus.

To generate high-quality aerosols despite repeated use of the aerosol generating apparatus, the aerosol generating apparatus needs to be kept clean. However, debris may accumulate inside the aerosol generating apparatus while the cigarette is heated to generate aerosols. The accumulated debris may contaminate the aerosol generating apparatus, thus weakening its performance and causing discomfort and inconvenience to a user.

In general, to clean the inside of the aerosol generating apparatus, a user holds the aerosol generating apparatus by hand, points a cigarette insertion hole towards the ground, and shakes the aerosol generating apparatus. However, since debris stuck inside the aerosol generating apparatus is not easily discharged from the aerosol generating apparatus, the user has to tap the cigarette insertion hole of the aerosol generating apparatus against a hard surface, such as a table, to remove the debris, and thus, cleaning is inconvenient and there is a risk of breaking a case.

In addition, when the aerosol generating apparatus is repeatedly used for a long time, debris may get stuck into an inner area of the aerosol generating apparatus which is not exposed to the outside through the cigarette insertion hole. In order to clean the inner area which is not exposed to the outside of the aerosol generating apparatus, only a special tool, such as a screwdriver, may be used to forcibly disassemble some parts thereof, and thus, it is difficult to clean the aerosol generating apparatus.

The above-described background art is technical information possessed by the inventors to derive the embodiments of the present disclosure or acquired in the process of deriving the embodiments, and may not be regarded as publicly known technology disclosed to the general public before the filing of the embodiments of the present disclosure.

DETAILED DESCRIPTION OF EMBODIMENTS

Technical Problem

According to embodiments of the present disclosure, provided is an aerosol generating apparatus that is easy to use and clean.

In addition, provided is an aerosol generating apparatus, which has higher durability and stability and the inside of which may be easily kept clean and maintained.

In addition, provided is an aerosol generating apparatus including a protrusion structure for preventing some parts of the apparatus from easily getting detached from the apparatus, to thereby prevent loss of such parts.

Solution to Problem

According to an embodiment of the present disclosure, an aerosol generating apparatus includes: a case including an insertion pipe for surrounding and supporting at least a portion of a cigarette; and an extraction member that includes a disk for supporting a lower end of the cigarette, the extraction member being slidably installed on the case, wherein the insertion pipe includes a step portion concaving away from an external surface to form an internal surface of the insertion pipe to allow mounting of the extraction member on the step portion, and based on the extraction member being removed from the case, the disk is configured to pressurize the lower end of the cigarette so that the cigarette is removed from the case.

According to the present embodiment, the insertion pipe may further include a guide hole to extend in a length direction of the cigarette, and the extraction member may further include a guide projection that is inserted into the guide hole to be slidable along the guide hole.

According to the present embodiment, the insertion pipe may further include a protrusion disposed above the guide hole and protruding in a direction crossing the length direction of the cigarette, and a width of the guide hole gradually decreases upwardly in the length direction of the cigarette.

According to the present embodiment, the guide projection may include, in a lower portion, a stopper protruding in a direction crossing the length direction of the cigarette, and based on the guide projection being inserted into the guide hole, the protrusion may be engaged with the stopper to apply a reaction-force to the guide projection to prevent the guide projection from entering the guide hole.

According to the present embodiment, based on a greater force than the reaction-force being applied to the extraction member, the protrusion may provide a path through which the stopper passes so that the guide projection is inserted into the guide hole.

According to the present embodiment, based on the extraction member being removed from the insertion pipe while the guide projection is inserted into the guide hole, the stopper may engage with the protrusion to apply a reaction-force to the guide projection to prevent the guide projection from being removed from the guide hole.

According to the present embodiment, based on a greater force than the reaction-force being applied to the extraction member, the protrusion may provide a path through which the stopper passes so that the guide projection is removed from the guide hole.

According to the present embodiment, each of the protrusion and the stopper may include an elastic material.

According to the present embodiment, the insertion pipe may include an air flow path providing a passage between the internal space of the insertion pipe and the outside.

According to the present embodiment, the extraction member may include a pressing handle protruding from an external surface of the extraction member and extending in a circumferential direction by a preset distance.

According to the present embodiment, an outer circumferential surface of the disk may contacts with an internal surface of the insertion pipe.

According to the present embodiment, the disk may include a through hole through which a heater for heating the cigarette passes.

In addition to the aforementioned details, other aspects, features, and advantages will be clarified from the following drawings, claims, and detailed description.

Advantageous Effects of Disclosure

According to an aerosol generating apparatus of embodiments of the present disclosure as described above, a cleaning operation may be quickly and safely performed by a simple operation of a user.

Also, as a surface of an extraction member is exposed to the outside, the user may hold the aerosol generating apparatus by gripping on a wide surface area of the aerosol generating apparatus, thereby increasing user convenience.

Also, detachment of the extraction member may be prevented using a simple structure, and the user may easily remove the extraction member from a case to clean the same as necessary.

Also, after generating aerosol from an aerosol-generating source, a flow of the generated aerosol may be passed through to a cigarette, thereby providing aerosol including flavor and nicotine or the like, that are suitable for a user.

BEST MODE

The terms used in the embodiments are general terms currently and widely used in the art in consideration of functions with respect to the present disclosure, but the terms may vary according to the intention of those of ordinary skill in the art, precedents, or new technology in the art. Also, specified terms may be selected by the applicant, and in this case, the detailed meaning thereof will be described in the detailed description of the disclosure. Thus, the terms used in the present disclosure should not be understood as simple names, but should be understood based on the meaning of the terms and the overall description of the present disclosure.

Throughout the specification, when a portion "includes" an element, another element may be further included, rather than excluding the existence of the other element, unless otherwise described. In addition, the terms "unit," "module," etc. described in the specification mean units for processing at least one function or operation and may be implemented by hardware components or software components or combinations thereof.

Hereinafter, the present disclosure will be described more fully with reference to the accompanying drawings, in which embodiments of the present disclosure are shown such that one of ordinary skill in the art may easily understand the present disclosure. However, the present disclosure may be embodied in many different forms and should not be construed as being limited to the embodiments set forth herein.

Hereinafter, embodiments of the present disclosure will be described in detail with reference to the drawings.

Figure 1:
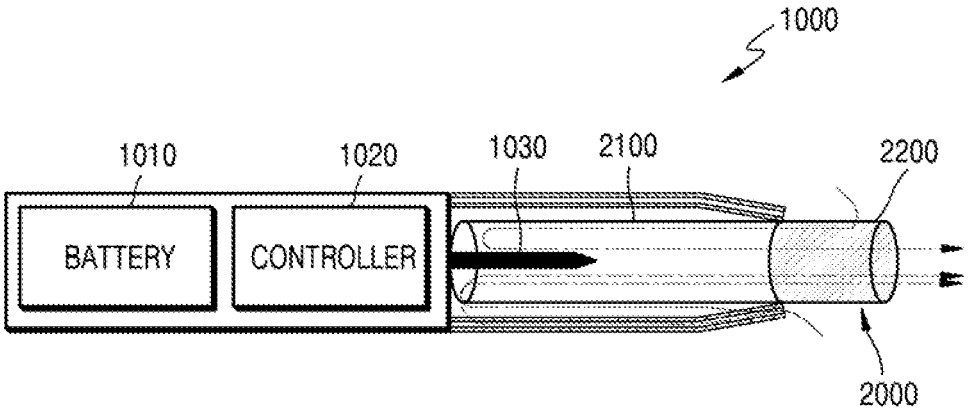
FIG. 1 is a diagram showing an example in which a cigarette is inserted into an aerosol generating apparatus.

FIG. 1 is a diagram showing an example in which a cigarette is inserted into an aerosol generating apparatus.

Referring to FIG. 1, the aerosol generating apparatus 1000 includes a battery 1010, a controller 1020, and a heater 1030. Also, the aerosol generating apparatus 1000 is inserted into an inside space of the cigarette 2000.

FIG. 1 shows the aerosol generating apparatus 1000 with some elements related to the embodiment. Therefore, it will be understood by one of ordinary skill in the art that the aerosol generating apparatus 1000 may further include additional general purpose elements in addition to elements shown in FIG. 1.

Although FIG. 1 shows that the battery 1010, controller 1020, and heater 1030 are arranged sequentially, the embodiments are not limited to this feature. In other words, arrangements of the battery 1010, controller 1020, and heater 1030 may be changed according to a design choice of the aerosol generating apparatus 1000.

When a cigarette 2000 is inserted into the aerosol generating apparatus 1000, the aerosol generating apparatus 1000 heats the heater 1030. The temperature of an aerosol generating material in the cigarette 2000 may be increased by the heated heater 1030, and thus aerosol is generated. The generated aerosol is delivered to a user through a cigarette filter 2200 of the cigarette 2000.

For example, for the purpose of cleaning the inner space of the aerosol generating apparatus, even when the cigarette 2000 is not inserted into the aerosol generating apparatus 1000, the aerosol generating apparatus 1000 may heat the heater 1030.

The battery 1010 supplies power to operate the aerosol generating apparatus 1000. For example, the battery 1010 may supply power for heating the heater 1030 and supply power for operating the controller 1020. In addition, the battery 1010 may supply power for operating a display, a sensor, a motor, and the like installed in the aerosol generating apparatus 1000.

The controller 1020 controls the overall operation of the aerosol generating apparatus 1000. Specifically, the controller 1020 controls not only the operations of the battery 1010 and the heater 1030, but also operations of other components included in the aerosol generating apparatus 1000. The controller 1020 may also check the status of each of the components of the aerosol generating apparatus 1000 and determine whether the aerosol generating apparatus 1000 is in an operable state.

The controller 1020 includes at least one processor. A processor may be implemented by an array of a plurality of logic gates or may be implemented by a combination of a microprocessor and a memory in which an executable program in the microprocessor is stored for execution by the microprocessor. It will be understood by one of ordinary skill in the art that the present disclosure may be implemented in other forms of hardware.

The heater 1030 is heated by power supplied from the battery 1010. For example, when a cigarette is inserted into the aerosol generating apparatus 1000, the heater 1030 may be located inside the cigarette. Therefore, the heated heater 1030 may increase the temperature of an aerosol generating material in the cigarette.

The heater 1030 may be an electrical resistive heater. For example, the heater 1030 includes an electrically conductive track, and the heater 1030 may be heated as electrical current flows through the electrically conductive track. However, the heater 1030 is not limited to the above example, but any heater structure being able to be heated to a desired temperature may be adapted. The desired temperature may be preset in the aerosol generating apparatus 1000, or the user may set the desired temperature.

As another example, the heater 1030 may be an inductive heater. Specifically, the heater 1030 may include an electrical conductive coil for heating in inductive heating method, and the cigarette may include a susceptor that may be heated by an inductive heater.

FIG. 1 shows that the heater 1030 is disposed so as to be inserted into the cigarette 2000, but the embodiments are not limited thereto. For example, the heater 1030 may include a pipe shaped heating element, a plate shaped heating element, a needle shaped heating element, or a rod shaped heating element, and may heat inside or outside of the cigarette 2000 based on the shape of the heating element.

Also, the aerosol generating apparatus 1000 may include a plurality of heaters 1030. Here, the plurality of heaters 1030 may be disposed so as to be inserted into the cigarette 2000, or may be disposed outside of the cigarette 2000. Also, a part of the plurality of heater 1030 may be disposed to be inserted into inside of the cigarette 2000, and other part of the plurality of heater 1030 may be disposed outside of the cigarette 2000. Also, shape of the heater 1030 is not limited to the shape of the heater shown in FIG. 1, and may be manufactured into various shapes.

Meanwhile, the aerosol generating apparatus 1000 may include general-purpose components other than the battery 1010, the controller 1020, and the heater 1030. For example, the aerosol generating apparatus 1000 may include a display capable of outputting visual information or a motor for outputting tactile information. The aerosol generating apparatus 1000 may also include at least one sensor such as a puff detecting sensor, a temperature sensing sensor, and a cigarette insertion detecting sensor.

In addition, the aerosol generating apparatus 1000 may be fabricated to have a structure in which outside air may flow in/out even in the state where the cigarette 2000 is inserted.

Although not shown in FIG. 1, the aerosol generating apparatus 1000 may form a part of the system along with an additional cradle. For example, the cradle may be used to charge the battery 1010 of the aerosol generating apparatus 1000. Also, the heater 1030 may be heated while the cradle and the aerosol generating apparatus 1000 are connected.

The cigarette 2000 may be similar to a typical burning cigarette. For example, the cigarette 2000 may include a first portion 2100 containing an aerosol generating material and a second portion 2200 including a filter and the like. Also, the cigarette 2000 may also include an aerosol generating material in the second portion 2200. For example, an aerosol generating material in the form of granules or capsules may be inserted into the second portion 2200.

The entire first portion 2100 may be inserted into the aerosol generating apparatus 1000 and the second portion 2200 may be exposed to the outside. Alternatively, only a portion of the first portion 2100 may be inserted into the aerosol generating apparatus 1000 or the entire first portion 2100 and a portion of the second portion 2200 may be inserted into the aerosol generating apparatus 1000. A user may inhale the aerosol from the second portion 2200 by his or her mouth. Here, the aerosol is generated from the outside air passing through the first portion 2100, and the generated aerosol is delivered to a user's mouth by passing through the second portion 2200.

As one example, the outside air may be introduced through at least one air passage formed in the aerosol generating apparatus 1000. For example, opening and closing of the air passage formed in the aerosol generating apparatus 1000 and/or a size of the air passage may be adjusted by the user. Accordingly, the amount of smoke and smoking experience may be adjusted by the user. As another example, outside air may be introduced into the cigarette 2000 through at least one hole formed on a surface of the cigarette 2000.

Hereinafter, one example of the cigarette 2000 will be explained with reference to FIG. 2.

Figure 2:
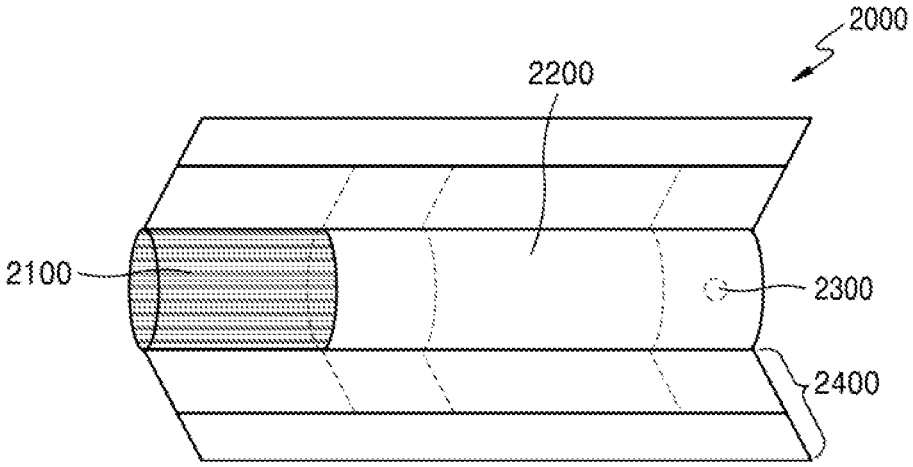
FIG. 2 is a diagram showing an example of a cigarette.

FIG. 2 is a diagram showing an example of a cigarette.

Referring to FIG. 2, the cigarette 2000 may include a tobacco rod 2100, a filter rod 2200. The first portion 2100 described above referring to FIG. 1 may include the tobacco rod 2100, and the second portion 2200 may include the filter rod 2200.

Although the filter rod 2200 is shown as one segment in FIG. 2, the filter rod is not limited thereto. In other words, the filter rod 2200 may be formed as a plurality of segments. For example, the filter rod 2200 may include a first segment for cooling aerosol and a second segment for filtering some elements included in aerosol. Also, the filter rod 2200 may further include at least one segment performing different functions as desired.

The cigarette 2000 may be packaged by at least one wrapper 2400. The wrapper 2400 may include at least one hole through which outside air may be introduced or inner gas may be discharged. As an example, the cigarette 2000 may be packaged by one wrapper 2400. As another example, the cigarette 2000 may be packaged in an overlapped manner by at least two or more wrappers 2400. For example, the cigarette 2000 may be packaged by a first wrapper and the filter rod 2200 may be packaged by a second wrapper. Additionally, the tobacco rod 2100 and filter rod 2200 may be connected after being packaged by separate wrappers, and then whole part of the cigarette 2000 may be packaged again by a third wrapper. If the tobacco rod 2100 or filter rod 2200 is made into a plurality of segments, each segment may be packaged by a separate wrapper. Also, whole part of the cigarette 2000 formed by connected segments, which are packaged by separate wrappers, may be packaged again by another wrapper.

The tobacco rod 2100 includes an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but not limited thereto. Also, the tobacco rod 2100 may include other additive materials like a flavoring agent, a wetting agent, and/or organic acid. Also, the flavoring liquid like menthol or wetting material may be added into the tobacco rod 2100 by being sprayed onto the tobacco rod 2100.

The tobacco rod 2100 may be manufactured in various methods. For example, the tobacco rod 2100 may be formed by using a sheet, or a strand. Also, the tobacco rod 2100 may be formed by using cut tobacco leaves being cut from tobacco sheet. Also, the tobacco rod 2100 may be surrounded by thermal conductive material. For example, the thermal conductive material may include metal foil such as aluminum foil, but not limited thereto. As one example, the thermal conductive material surrounding the tobacco rod 2100 may increase thermal conductivity by evenly dispersing heat which is conducted to tobacco rod 2100, and therefore increasing the taste of tobacco. Also, the thermal conductive material surrounding the tobacco rod 2100 may function as a susceptor being heated by an inductive heating type heater. In this case, although not shown in drawings, the tobacco rod 2100 may further include an additional susceptor in addition to the thermal conductive material surrounding the outside of tobacco rod.

The filter rod 2200 may be a cellulose acetate filter. Meanwhile, the shape of the filter rod 2200 is not limited to a specific shape. For example, the filter rod 2200 may be a cylindrical shape type rod or a tube type rod with a hollow cavity therein. Also, the filter rod 2200 may be a recess shape type rod. If the filter rod 2200 is made of a plurality of segments, at least one of the plurality of segments may be made into a different shape.

The filter rod 2200 may be formed to generate a flavor. For example, a flavoring liquid may be sprayed on the filter rod 2200, or a separate fiber coated with a flavoring liquid may be inserted into the inside of the filter rod 2200.

Also, the filter rod 2200 may include at least of one capsule 2300. Here, the capsule 2300 may perform generating a flavor and generating aerosol. For example, the capsule 2300 may have a configuration in which a content liquid including a flavoring material is wrapped with a film. For example, the capsule 2300 may have a spherical or cylindrical shape.

If the filter rod 2200 includes a cooling segment for cooling aerosol, the cooling segment may be composed of a polymer or bio-degradable polymer. For example, the cooling segment may be formed by polylactic acid, but not limited thereto. Alternatively, the cooling segment may be made of a cellulose acetate filter having a plurality of holes. However, the cooling segment is not limited to the above described examples, but may include any configuration with cooling function to be applied to the cooling segment.

Figure 3:
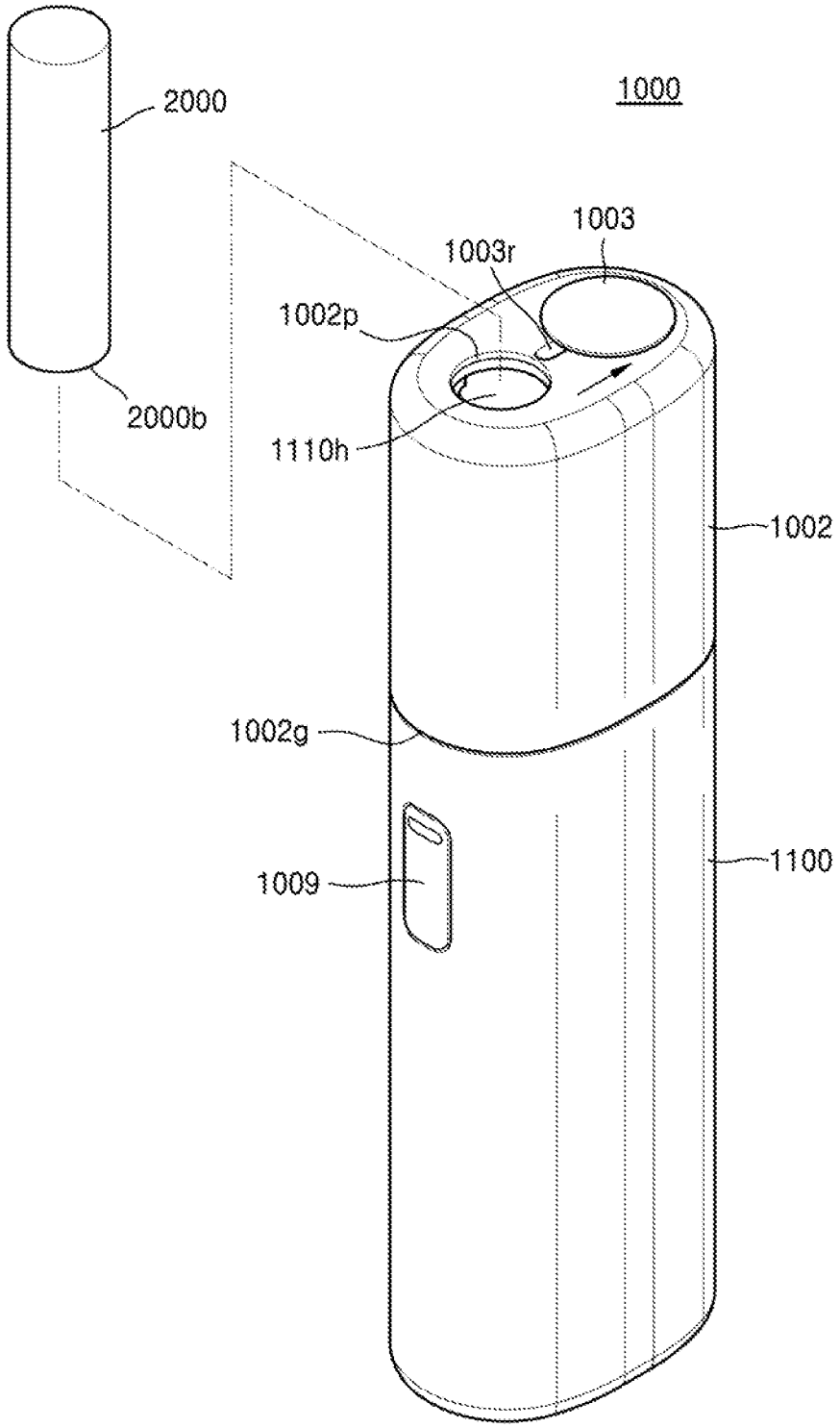
FIG. 3 is a perspective view illustrating an outer appearance of an aerosol generating apparatus according to an embodiment of the present disclosure.

FIG. 3 is a perspective view of the outer appearance of an aerosol generating apparatus according to an embodiment of the present disclosure.

The aerosol generating apparatus 1000 according to the embodiment shown in FIG. 3 may include a case 1100 and a cover 1002. The cover 1002 is coupled with a first end of the case 1100, and thus the cover 1002 constitutes the outer appearance of the aerosol generating apparatus together with the case 1100.

The case 1100 constitutes the outer appearance of the aerosol generating apparatus 1000 and functions to accommodate and protect various components in a space formed therein.

The cover 1002 and the case 1100 may include a plastic material with low heat conductivity or a metal coated with a heat barrier material on its surface. The cover 1002 and the case 1100 may be fabricated through, for example, an injection molding method, a 3D printing method, or a method of assembling small parts fabricated through injection molding.

A locking device (not shown) may be installed between the cover 1002 and the case 1100 to maintain the attachment between the cover 1002 and the case 1100. The locking device may include, for example, a protrusion and a groove. The attachment between the cover 1002 and the case 1100 may be maintained by maintaining a state in which the protrusion is inserted into the groove, and a structure in which the protrusion is moved by a manipulation button that may be pressed by a user so as to separate the protrusion from the groove may also be used.

The locking device may also include, for example, a magnet and a metal member that sticks to the magnet. When a magnet is used for the locking device, a magnet may be installed on either the cover 1002 or the case 1100, and a metal that sticks to the magnet may be attached to the other one. Alternatively, magnets may be installed on both the cover 1002 and the case 1100.

In the aerosol generating apparatus 1000 according to the embodiment shown in FIG. 3, the cover 1002 is not an essential configuration, so the cover 1002 may not be installed.

An outside hole 1002*p* through which the cigarette 2000 may be inserted is formed on the top surface of the cover 1002 coupled to the case 1100. Also, a rail 1003*r* is formed on the top surface of the cover 1002 at a position adjacent to the outside hole 1002*p*. A door 1003 that is slidable along the top surface of the cover 1002 may be installed on the rail 1003*r*. The door 1003 may slide in a straight line along the rail 1003*r*.

As the door 1003 moves along the rail 1003*r* in the direction indicated by the arrow in FIG. 3, the outside hole 1002*p* and an accommodating path 1110*h* that enable the cigarette 2000 to be inserted into the case 1100 through the cover 1002 are exposed to the outside. The outside hole 1002*p* of the cover 1002 exposes the accommodating path 1110*h* capable of accommodating the cigarette 2000 to the outside.

When the outside hole 1002*p* is exposed to the outside by the door 1003, a user may insert an end portion 2000*b* of the cigarette 2000 into the outside hole 1002*p* and the accommodating path 1110*h*, thereby placing the cigarette 2000 in the accommodating path 1110*h* formed inside the housing 1002.

In the embodiment shown in FIG. 3, the door 1003 is installed to move in a straight line with respect to the cover 1002. However, the embodiment is not limited by the structure in which the door 1003 is coupled with the cover 1002. For example, the door 1003 may be rotatably mounted on the cover 1002 through a hinge assembly. In case of employing a hinge assembly, the door 1003 may be rotated toward a side surface of the outside hole 1002*p* in a direction in which the top surface of the cover 1002 extends or the door 1003 may be rotated in a direction away from the top surface of the cover 1002.

The rail 1003*r* may have a concave groove shape, but the embodiment is not limited thereto. For example, the rail 1003*r* may have a convex shape or may extend in a curved shape instead of a straight shape.

On the case 1100, a button 1009 may be provided. As the button 1009 is manipulated, the operation of the aerosol generating apparatus may be controlled.

An outside air introduction gap 1002*g* that allows the air to flow into the interior of the cover 1002 may be formed at a portion where the cover 1002 comes into contact with the case 1100 when the cover 1002 is coupled to the case 1100.

Figure 4:
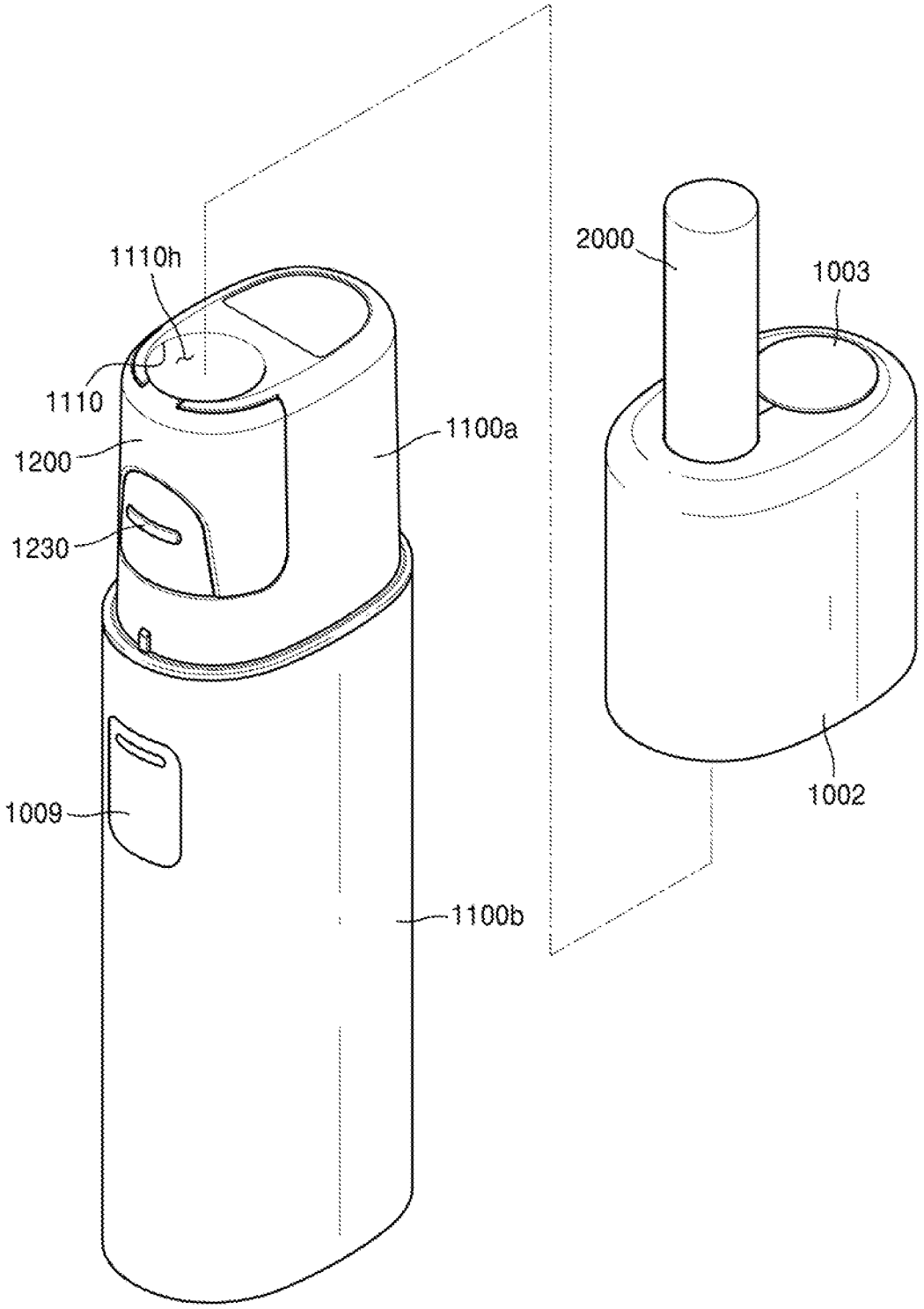
FIG. 4 is a perspective view illustrating an operating state in which some components are removed from the aerosol generating apparatus according to the embodiment illustrated in FIG. 3.
Figure 5:
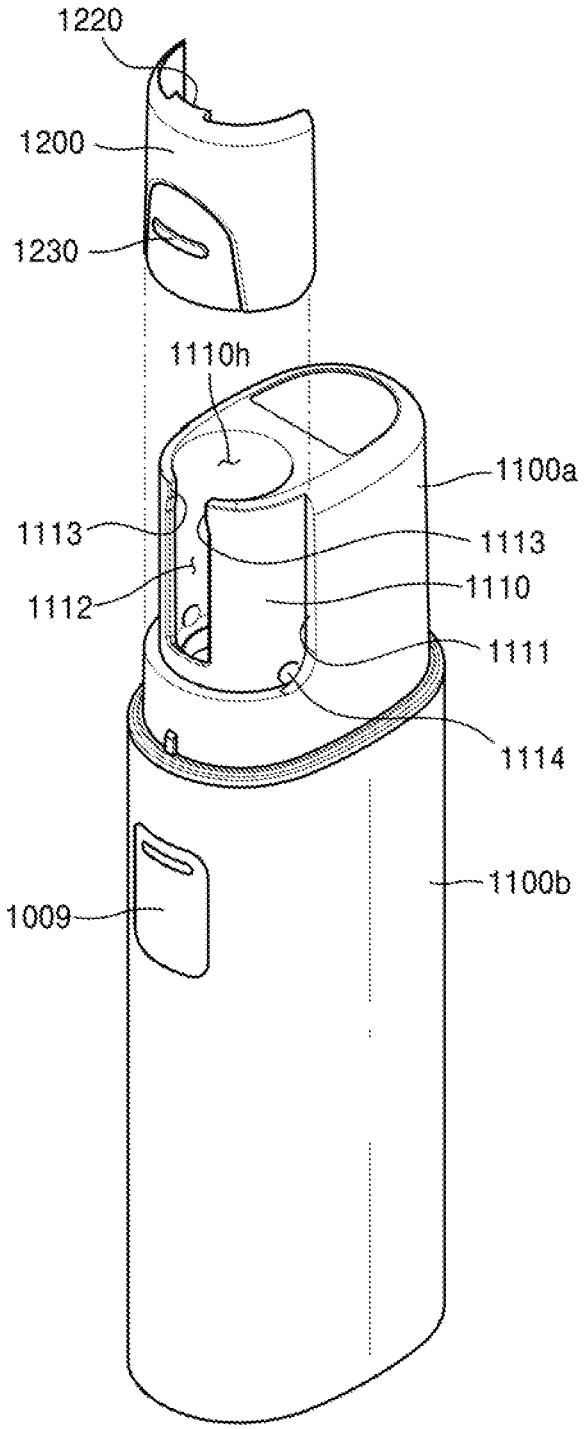
FIG. 5 is a perspective view illustrating an operating state in which some components are being removed from the aerosol generating apparatus according to the embodiment illustrated in FIG. 3.
Figure 6:
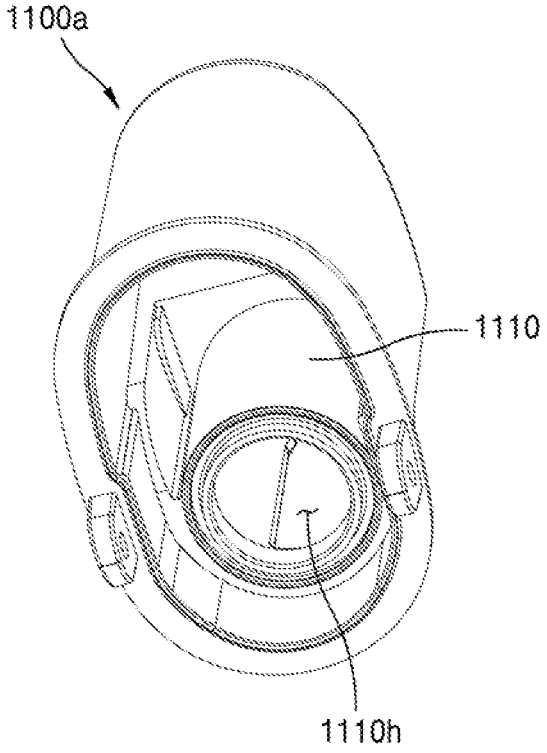
FIG. 6 is a bottom perspective view of an upper case of the aerosol generating apparatus according to the embodiment illustrated in FIG. 5.
Figure 7:
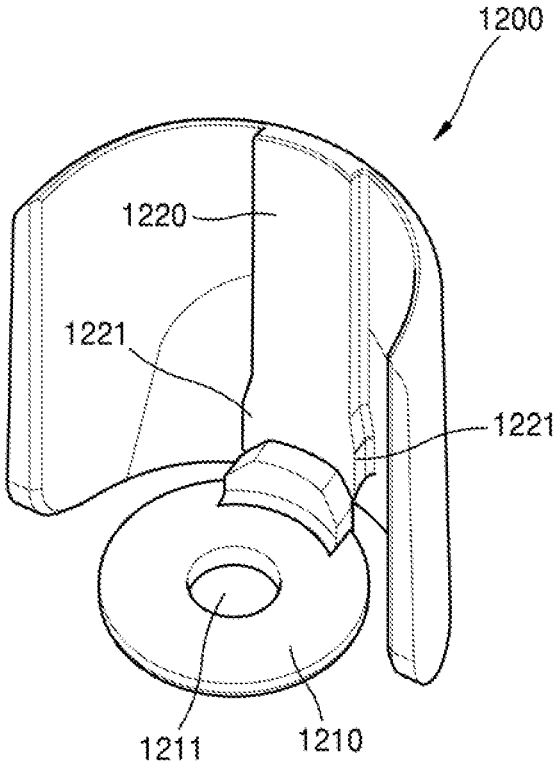
FIG. 7 is a perspective view of an extraction member of the aerosol generating apparatus according to the embodiment of FIG. 5.

FIG. 4 is a perspective view illustrating an operating state in which some components are removed from the aerosol generating apparatus according to the embodiment illustrated in FIG. 3. FIG. 5 is a perspective view illustrating an operating state in which some components are being removed from the aerosol generating apparatus according to the embodiment illustrated in FIG. 3. FIG. 6 is a bottom perspective view of an upper case of the aerosol generating apparatus according to the embodiment illustrated in FIG. 5. FIG. 7 is a perspective view of an extraction member of the aerosol generating apparatus according to the embodiment of FIG. 5.

The aerosol generating apparatus 1000 illustrated in FIGS. 4 and 5 includes the case 1100 and an extraction member 1200.

The case 1100 may include an upper case 1100*a* and a lower case 1100*b*. The upper case 1100*a* may be covered by the cover 1002, and the extraction member 1200 may be detachably installed on the upper case 1100*a*. The upper case 1100*a* includes the accommodation path 1110*h* accommodating the cigarette 2000, and the heater 1030 heating the cigarette 2000 may be arranged in the accommodation path 1110*h* (see FIGS. 8 and 9).

The lower case 1100*b* may accommodate and protect internal components such as the battery 1010 and the controller 1020.

Referring to FIGS. 5 and 6, the case 1100 includes an insertion pipe 1110 supporting at least a portion of the cigarette 2000. The insertion pipe 1110 is in a pipe shape accommodating the cigarette 2000, and the insertion pipe 1110 includes a step portion 1111 that concaves away from an external surface to form an internal surface thereof so that the extraction member 1200 is mounted on the step portion 1111, a guide hole 1112 opened to extend in a length direction of the cigarette 2000, a protrusion 1113 protruding above the guide hole 1112 in a direction crossing the length direction of the cigarette 2000, and an air flow path 1114 creating a passage between the internal space of the insertion pipe 1110 to the outside.

Here, a width of the guide hole 1112 in the length direction of the cigarette 2000 may gradually decrease upwardly due to the protrusion 1113. According to the structure of the guide hole 1112 described above, as a stopper 1221 of the extraction member 1200 and the protrusion 1113 may be engaged with each other, and the extraction member 1200 may be prevented from easily detaching from the insertion pipe 1110, thereby preventing the risk of losing the extraction member 1200 due to carelessness of a user. This will be described in detail with reference to FIG. 9.

The extraction member 1200 is slidably installed on the case 1100, and may be stably mounted on the step portion 1111 of the insertion pipe 1110. In detail, the extraction member 1200 may include a guide projection 1220 that is inserted into the guide hole 1112 to be slidable along the guide hole 1112 and a pressing handle 1230 protruding from an external surface of the extraction member 1200 to extend in a circumferential direction. A user may conveniently operate the extraction member 1200 by using the pressing handle 1230.

Referring to FIG. 7, the extraction member 1200 includes a disk 1210 supporting a lower end of the cigarette 2000. When the extraction member 1200 is removed from the case 1100, the disk 1210 may pressurize the lower end of the cigarette 2000 to remove the cigarette 2000 from the case 1100.

An outer circumferential surface of the disk 1210 may contact an internal surface of the insertion pipe 1110. When a gap is formed between the disk 1210 and the internal surface of the insertion pipe 1110, during an operation of removing the extraction member 1200 from the case 1100, debris remaining at the lower end of the cigarette 2000 may remain in the accommodation path 1110*h* in the insertion pipe 1110 through the gap between the disk 1210 and the internal surface of the insertion pipe 1110.

However, according to the embodiment, the extraction member 1200 slides upwardly while the outer circumferential surface of the disk 1210 is adhering to the internal surface of the insertion pipe 1110, and thus, the debris remaining at the lower end of the cigarette 2000 may be effectively eliminated from the accommodation path 1110*h*.

In addition, the disk 1210 may include a through hole 1211 through which the heater 1030 heating the cigarette 2000 passes.

The guide projection 1220 of the extraction member 1200 includes, in a lower portion thereof, the stopper 1221 protruding in a direction crossing the length direction of the cigarette 2000. According to the above-described structure, when the guide projection 1220 is about to be inserted into the guide hole 1112 of the insertion pipe 1110, the stopper 1221 may be engaged with the protrusion 1113 formed above the guide hole 1112. That is, the protrusion 1113 may be engaged with the stopper 1221, and thus applying a reaction-force to the guide projection 1220 to prevent the guide projection 1220 from entering the guide hole 1112. When a user applies, to the extraction member 1200, a greater force than the reaction-force applied by the protrusion 1113 to the stopper 1221, the protrusion 1113 may allow entry of the stopper 1221 so that the guide projection 1220 is inserted into the guide hole 1112.

A cleaning operation of the aerosol generating apparatus 1000 may be performed in a manner in which a user removes the cover 1002 from the case 1100 of the aerosol generating apparatus 1000 and then removes the extraction member 1200 from the case 1100 and exposes the internal space of the aerosol generating apparatus 1000 and the heater 1030 or the like to eliminate tobacco materials.

Referring back to FIG. 4, the cover 1002 may be coupled to the upper case 1100*a* to cover the extraction member 1200 that is coupled to the upper case 1100*a*. Also, according to necessity, the cover 1002 may be removed from the case 1100.

As an example, after finishing the cigarette 2000, and when removing the cigarette 2000 from the aerosol generating apparatus 1000, the user may hold the cigarette 2000 by hand and rotatably remove the cigarette 2000 from the case 1100.

Alternatively, when removing the cigarette 2000 from the aerosol generating apparatus 1000, as illustrated in FIG. 4, the user may rotate the cigarette 2000 and then pull the cover 1002 to remove the cover 1002 from the case 1100 together with the cigarette 2000.

By removing the cigarette 2000 from the case 1100 by rotating the cigarette 2000, an attachment state between the cigarette 2000 and the heater 1030 may be released, and at the same time, tobacco materials attached to the cigarette 2000 may be discharged out of the case 1100 together with the cigarette 2000.

If the cover 1002 is pulled without rotating the cigarette 2000, the cigarette 2000 may be removed from the case 1100, but a portion of the cigarette 2000, for example, a tobacco portion may not be discharged from the case 1100, but remain on the heater 1030. In this case, the user may remove the cover 1002 from the case 1100 and then remove the extraction member 1200 from the case 1100 as illustrated in FIG. 5. Here, the tobacco portion remaining on the heater 1030 may be removed from the case 1100 together with the extraction member 1200. Subsequently, the user may eliminate the tobacco portion remaining in the removed extraction member 1200.

MODE OF DISCLOSURE

Hereinafter, an operation of removing the extraction member 1200 from the case 1100 while the extraction member 1200 is installed on the case 1100 will be described in detail with reference to FIGS. 8 and 9.

Figure 8:
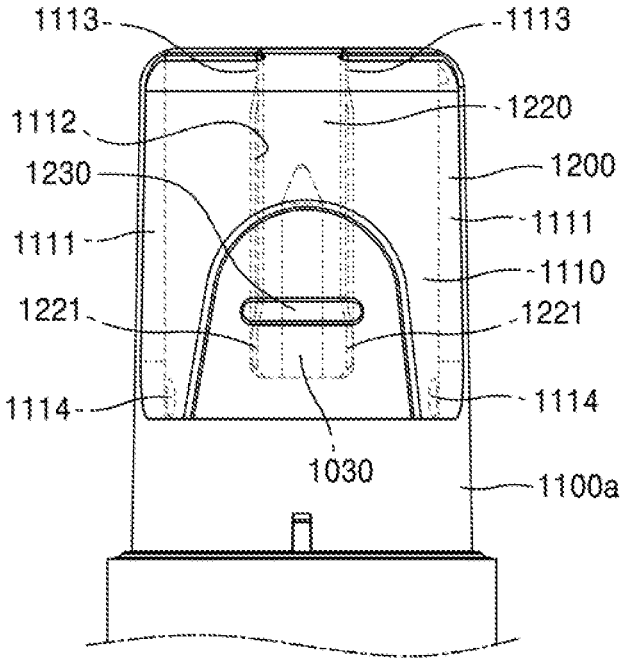
FIG. 8 is a front perspective view illustrating an extraction member of the aerosol generating apparatus installed on a case according to the embodiment illustrated in FIG. 5.

FIG. 8 is a front perspective view illustrating an extraction member of the aerosol generating apparatus according to the embodiment illustrated in FIG. 5 installed on a case. FIG. 9 is a front perspective view illustrating that a stopper of the extraction member of the aerosol generating apparatus according to the embodiment illustrated in FIG. 8 and a protrusion of the case are engaged with each other while the extraction member is being removed from the case.

Referring to FIG. 8, the extraction member 1200 may be installed on the case 1100. Specifically, the extraction member 1200 may be fit-coupled to the step portion 1111 formed on an external surface of the insertion pipe 1110. In addition, an inner portion of the extraction member 1200 may be coupled to the insertion pipe 1110 while the guide projection 1220 is maintained in a state inserted into the guide hole 1112 which is formed in a lateral surface of the insertion pipe 1110.

According to this structure, the extraction member 1200 may be stably coupled to the insertion pipe 1110, and as a broad surface thereof is exposed to the outside, user convenience in terms of removing the extraction member 1200 from the insertion pipe 1110 may be increased. Moreover, the pressing handle 1230 may be included on an external surface of the extraction member 1200, and thus, the user may operate the pressing handle 1230 to easily vertically slide the extraction member 1200 with respect to the case 1100.

Figure 9:
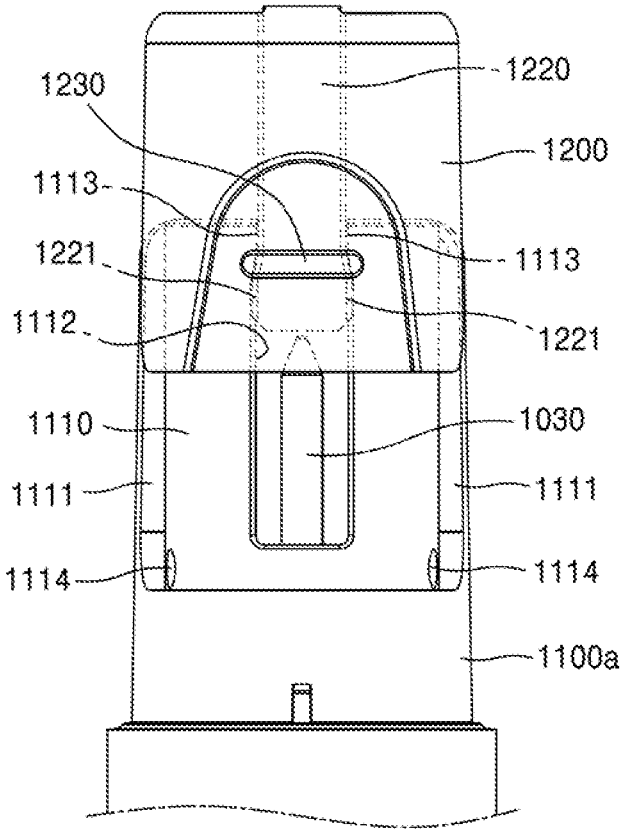
FIG. 9 is a front perspective view illustrating that a stopper of the extraction member of the aerosol generating apparatus according to the embodiment illustrated in FIG. 8 and a protrusion of the case being engaged with each other while the extraction member is being removed from the case.

Referring to FIG. 9, while the guide projection 1220 is inserted into the guide hole 1112, and when the extraction member 1200 is to be removed from the insertion pipe 1110, the guide projection 1220 may be upwardly moved along the guide hole 1112, and at a point where the stopper 1221 of the guide projection 1220 and the protrusion 1113 of the insertion pipe 1110 are engaged with each other, the extraction member 1200 may be prevented from sliding upwardly. In other words, as the stopper 1221 and the protrusion 1113 are engaged with each other, the stopper 1221 may apply a reaction-force to the guide projection 1220 so that the guide projection 1220 is not removed from the guide hole 1112.

In this state, when the user lifts the extraction member 1200 by applying a greater force to the extraction member 1200 than the reaction-force applied to the guide projection 1220 by the stopper 1221, the guide projection 1220 may be removed from the guide hole 1112.

Meanwhile, the protrusion 1113 and the stopper 1221 may include an elastic material. That is, while the protrusion 1113 and the stopper 1221 are engaged with each other, when the user lifts the extraction member 1200 upwardly, the protrusion 1113 is compressed by the stopper 1221 by a certain gap to form a path through which the stopper 1221 may pass, and after the stopper 1221 has passed through, the protrusion 1113 may expand again to be restored to its original position.

According to the embodiments of the aerosol generating apparatus 1000 described above, by applying, to the extraction member 1200, a force to the extent to overcome the engagement force between the stopper 1221 and the protrusion 1113, the user may easily remove the extraction member 1200 from the insertion pipe 1110. This indicates that, unless a force that allows to overcome the engagement force between the stopper 1221 and the protrusion 1113 is applied to the extraction member 1200, the extraction member 1200 may not be removed from the insertion pipe 1110. Accordingly, detachment of the extraction member 1200 from the case 1100 due to carelessness of a user may be effectively prevented using a simple structure.

The configuration and effects of the above-described embodiments are merely examples, and it will be understood by those of ordinary skill in the art that various changes may be made therein without departing from the spirit and scope of the present disclosure. Therefore, the scope of the present disclosure will be defined by the appended claims.

INDUSTRIAL APPLICABILITY

Embodiments relate to an aerosol generating apparatus that may be conveniently cleaned.

What is claimed is:

1. An aerosol generating apparatus comprising:
   a case comprising an insertion pipe for surrounding and supporting at least a portion of a cigarette; and
   an extraction member that comprises a disk for supporting a lower end of the cigarette, the extraction member being slidably installed on the case,
   wherein the insertion pipe comprises a step portion concaving away from an external surface to form an internal surface of the insertion pipe to allow mounting of the extraction member on the step portion, and
   wherein, based on the extraction member being removed from the case, the disk is configured to pressurize the lower end of the cigarette so that the cigarette is removed from the case.

2. The aerosol generating apparatus of claim 1, wherein the insertion pipe further comprises a guide hole to extend in a length direction of the cigarette, and
   wherein the extraction member further comprises a guide projection that is inserted into the guide hole to be slidable along the guide hole.

3. The aerosol generating apparatus of claim 2, wherein the insertion pipe further comprises a protrusion disposed above the guide hole and protruding in a direction crossing the length direction of the cigarette, and
   wherein a width of the guide hole gradually decreases upwardly in the length direction of the cigarette.

4. The aerosol generating apparatus of claim 3, wherein the guide projection comprises, in a lower portion, a stopper protruding in a direction crossing the length direction of the cigarette, and
   wherein, based on the guide projection being inserted into the guide hole, the protrusion is engaged with the stopper to apply a reaction-force to the guide projection to prevent the guide projection from entering the guide hole.

5. The aerosol generating apparatus of claim 4, wherein, based on a greater force than the reaction-force being applied to the extraction member, the protrusion provides a path through which the stopper passes so that the guide projection is inserted into the guide hole.

6. The aerosol generating apparatus of claim 4, wherein, based on the extraction member being removed from the insertion pipe while the guide projection is inserted into the guide hole, the stopper engages with the protrusion to apply the reaction-force to the guide projection to prevent the guide projection from being removed from the guide hole.

7. The aerosol generating apparatus of claim 6, wherein, based on a greater force than the reaction-force being applied to the extraction member, the protrusion provides a path through which the stopper passes so that the guide projection is removed from the guide hole.

8. The aerosol generating apparatus of claim 4, wherein each of the protrusion and the stopper comprises an elastic material.

9. The aerosol generating apparatus of claim 1, wherein the insertion pipe comprises an air flow path providing a passage between the internal space of the insertion pipe and the outside.

10. The aerosol generating apparatus of claim 1, wherein the extraction member comprises a pressing handle protruding from an external surface of the extraction member and extending in a circumferential direction by a preset distance.

11. The aerosol generating apparatus of claim 1, wherein an outer circumferential surface of the disk contacts with an internal surface of the insertion pipe.

12. The aerosol generating apparatus of claim 1, wherein the disk comprises a through hole through which a heater for heating the cigarette passes.

* * * * *